US005974637A

United States Patent [19]

Tracy et al.

[11] Patent Number: 5,974,637

[45] Date of Patent: Nov. 2, 1999

[54] HIGH STRENGTH COMPOSITE BUCKLE

[75] Inventors: Richard J. Tracy, Elgin; E. Grant Swick, Bartlett; Roger A. Erber, Harvard, all of Ill.

[73] Assignee: National Molding Corporation, Farmingdale, N.Y.

[21] Appl. No.: 09/218,583

[22] Filed: Dec. 22, 1998

[51] Int. Cl.[6] ..... A44B 11/00

[52] U.S. Cl. ..... 24/633; 24/615; 24/625

[58] Field of Search ..... 24/633, 634, 635, 24/625, 615

[56] References Cited

U.S. PATENT DOCUMENTS

| | | | |
|---|---|---|---|
| 3,262,169 | 7/1966 | Jantzen | 24/634 |
| 4,987,662 | 1/1991 | Haffey et al. | 24/633 |
| 5,291,641 | 3/1994 | Morino | 24/633 |
| 5,355,562 | 10/1994 | Matoba et al. | 24/625 |
| 5,546,642 | 8/1996 | Anscher | 24/625 |

FOREIGN PATENT DOCUMENTS

| | | | |
|---|---|---|---|
| 0575538 | 5/1959 | Canada | 24/634 |

*Primary Examiner*—Victor N. Sakran
*Attorney, Agent, or Firm*—Collard & Roe, P.C.

[57] ABSTRACT

A composite buckle comprising a metal male portion that is attachable to a strap and an insertion plate having two flat surfaces, and a female portion for receiving the male portion. The female portion comprises a metal locking body that is attachable to a strap and at least two locking legs adapted to releasably lock with the insertion plate of the male portion. The male portion is inserted between the two locking legs which engage the plate on opposite surfaces of the plate. There is a plastic housing surrounding at least a portion of the metal locking body. The housing has a flexible arm adapted to separate the locking legs and release the metal locking body from the male portion. The buckle according to the invention combines the strength of a metal buckle with the light weight and attractiveness of a plastic buckle, to form a composite buckle that is suitable for a variety of uses.

8 Claims, 7 Drawing Sheets

HIGH STRENGTH COMPOSITE BUCKLE

BACKGROUND OF THE INVENTION

1. Field of the Invention

This invention relates to a high-strength composite buckle for a variety of purposes, such as for use on dog collars and motorcycle helmets. In particular, this invention relates to a male-female side release buckle made of a combination of metal and plastic components, which can withstand high stresses.

2. The Prior Art

Multi-purpose buckles are usually made of either metal components or plastic components. Metal buckles have the advantage of high strength and durability, but are not very attractive and are difficult to manufacture. In addition, they add a significant amount of weight to the device on which the buckle is to be used. Plastic buckles are simpler to manufacture and are very lightweight as well as attractive. However, they cannot withstand very high stresses as well as metal buckles.

It would be desirable to have a buckle that provides both the strength of a metal buckle with the weight and appearance of a plastic buckle in a manner that is easy to manufacture, assemble and use.

SUMMARY OF THE INVENTION

It is therefore an object of the invention to provide a buckle that can withstand very high degrees of stress on the locking components.

It is another object of the invention to provide a buckle that is lightweight and aesthetically pleasing.

It is yet another object of the invention to provide a buckle that is simple and inexpensive to manufacture and assemble.

These and other objects of the invention are accomplished by a buckle comprising a metal male portion having means for attachment to a strap and an insertion plate having two flat surfaces, and a female portion for receiving the male portion. The female portion comprises a metal locking body having means for attaching the female portion to a strap and at least two locking legs adapted to releasably lock with the insertion plate of the male portion via latches on each of the legs. The male portion is inserted between the locking legs which engage the insertion plate on opposite surfaces of the plate. The locking legs are pried apart by the insertion plate, and flex at their connection point to the rest of the locking body. To accomplish this, the locking legs are narrower at this portion so that the flex occurs at this attachment point during insertion of the male portion.

There is a plastic housing surrounding at least a portion of the metal locking body. The housing has means for separating the locking legs and releasing the male metal portion from the body.

The buckle according to the present invention therefore has the advantage that all of the locking portions are made of metal, but the body of the buckle is made of plastic, so that it is more aesthetically pleasing and lighter in weight. None of the plastic portions are subject to any stresses or torques, so the buckle is extremely durable.

The metal locking body on the female portion preferably has four locking legs, with two of the legs locking on one side of the male portion and the other two legs locking on an opposite side of the male portion. This way, the male portion is locked in from both the top and bottom, so that the male portion cannot be released from the female portion when it is subjected to severe torques.

The insertion plate of the male portion preferably has two apertures therethrough for receiving the latches on each locking leg. Each latch on the locking legs engages one of the two apertures to lock the male portion to the female portion when the male portion is inserted between the two locking legs. Preferably, each locking leg has two latches, one on each lateral edge of the leg. Thus, when there are four locking legs, eight latches are coupled to the two apertures, four in each aperture, to ensure a secure lock between the male and female portions of the buckle.

Alternatively, the locking legs could be equipped with apertures and the insertion plate of the male portion could be equipped with latches for latching into the apertures. Forcing the legs apart would release the male portion from the locking legs in the same way described above.

The means for separating the locking legs preferably comprises at least one, and preferably two arms integrally formed with the plastic housing along the sides of the housing. Each arm has a free end with a finger extending toward the metal locking body. Pressing the free end of the arm inward toward the metal portions forces the finger between two locking legs and forces the locking legs apart to release the male portion from the female portion.

For ease of assembly, the plastic housing preferably comprises a the base and a cover. The metal locking body is mounted in base, and the cover is placed over the metal locking body to assemble the female portion. The cover is then welded in place.

The metal locking body preferably comprises two identical flat pieces, each piece containing two locking legs. Placing the pieces together one on top of the other forms four locking legs. Each of the locking legs have longitudinal ridges extending along two edges of each leg facing away from the latches and the locking legs are offset from the center line of the piece. This way, placing the two pieces together causes latches on one piece to nest with the latches on the other piece.

The means for attaching the female and male portions to a strap comprises at least one bar mounted across an end of the male portion and the metal part of the female portion.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
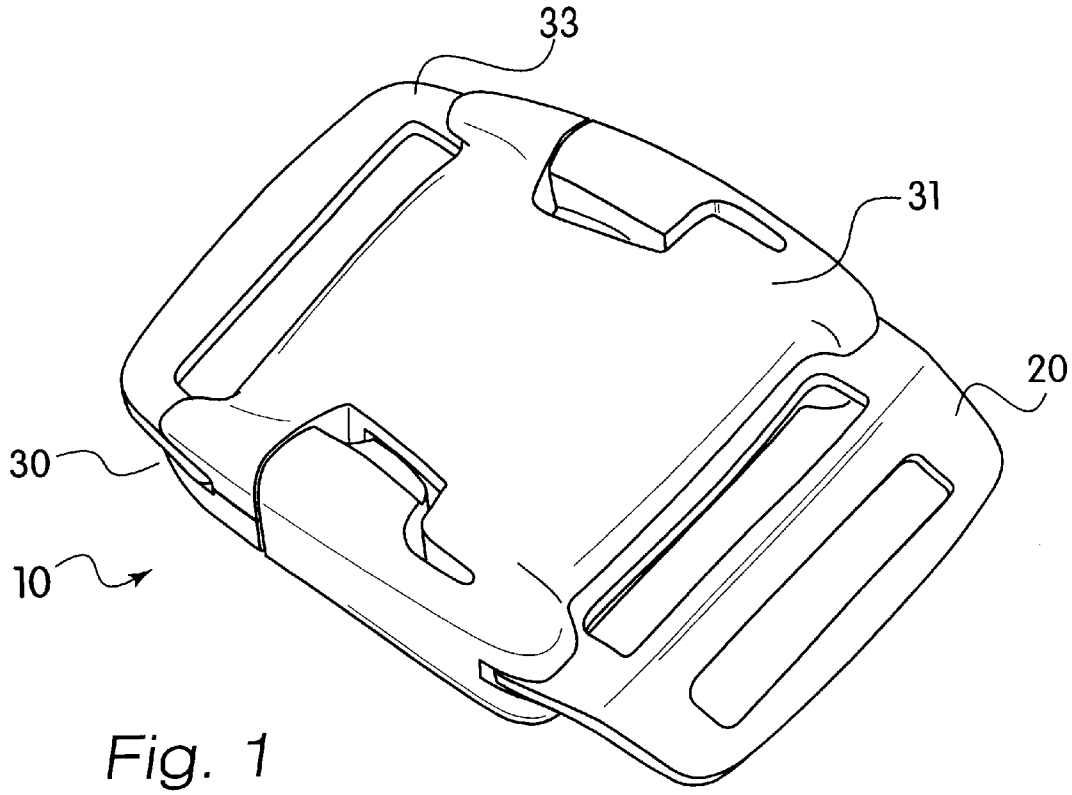
FIG. 1 shows a perspective view of the buckle according to the invention in the locked position.

Referring now in detail to the drawings and, in particular, FIG. 1, there is shown the buckle 10 according to the invention. Buckle 10 is comprised of a metal male portion 20 and a composite female portion 30. Composite female portion 30 is made up of a housing having a base 31, a cover 32 and two metal locking pieces 33 placed together.

Figure 2:
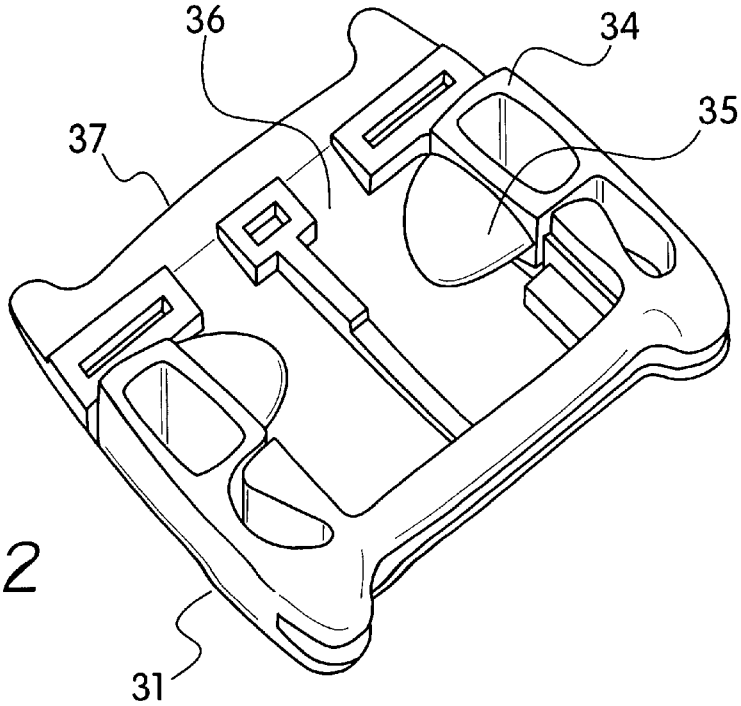
FIG. 2 shows a perspective view of the interior of the base of the plastic housing in the buckle according to the invention.
Figure 3:
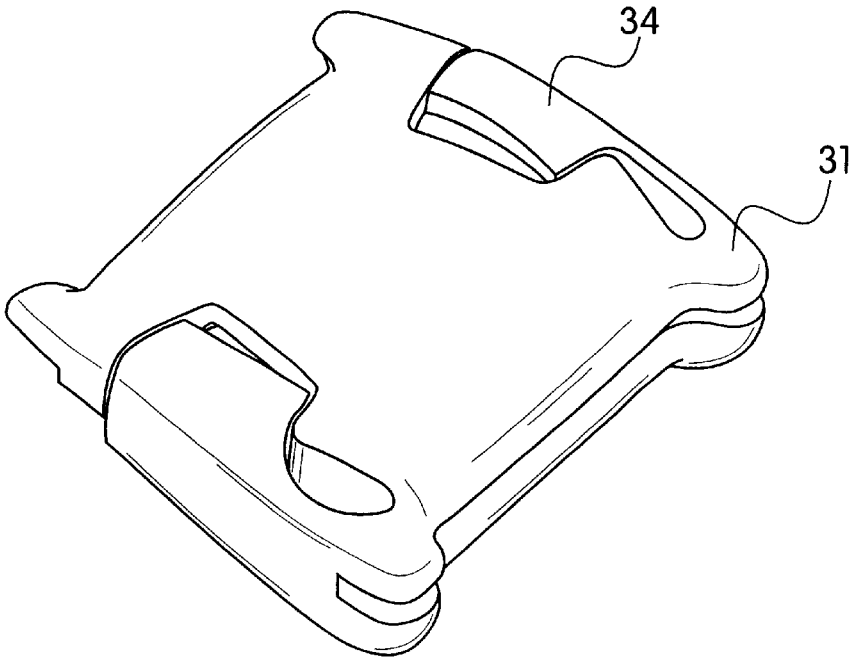
FIG. 3 shows a perspective view of the exterior of the base shown in FIG. 2.
Figure 4:
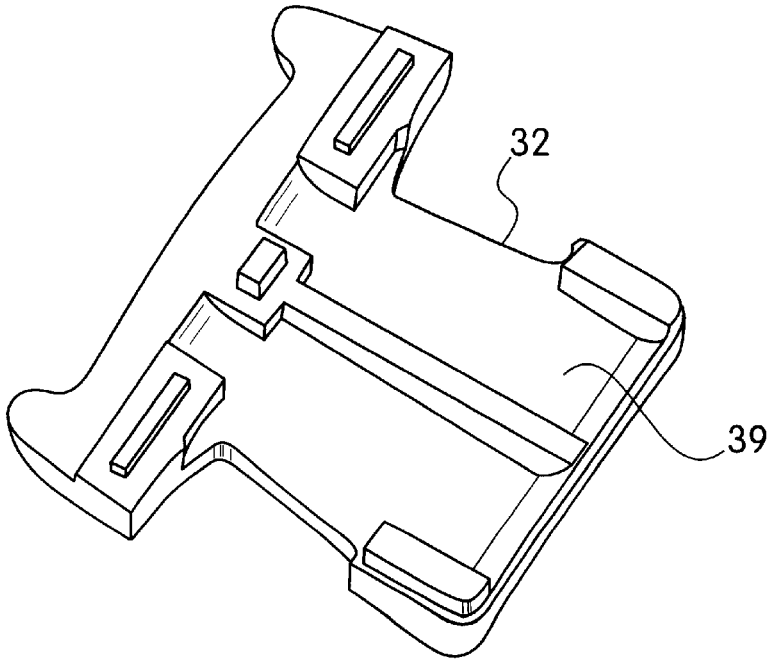
FIG. 4 shows a perspective view of the interior of the cover in the buckle according to the invention.
Figure 5:
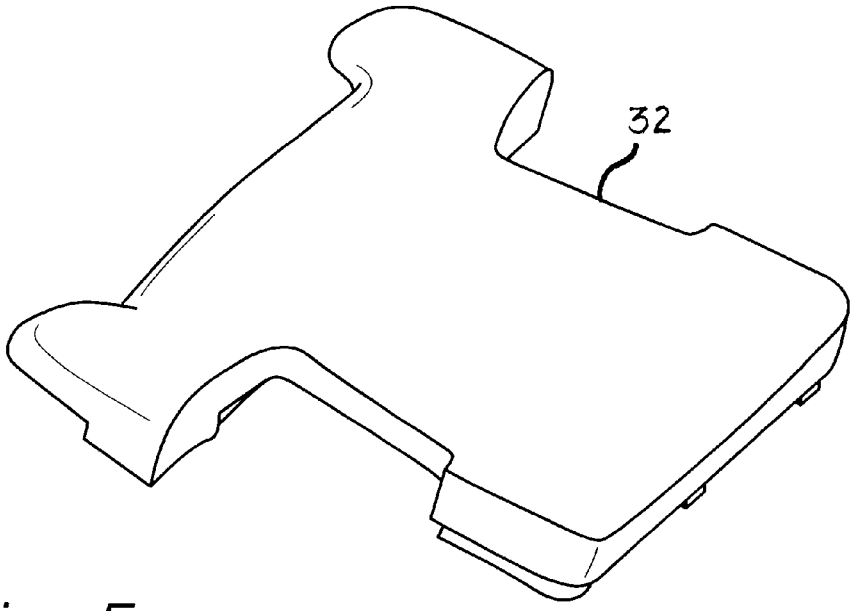
FIG. 5 shows a perspective view of the exterior of the cover shown in FIG. 4.

Base 31, shown in FIGS. 2 and 3, is a molded plastic piece having two flexible arms 34 integrally molded therewith. Each arm 34 has an inwardly-projecting finger 35 which is used to release buckle 10 as described below. Base 31 has a divided receptacle 36 for receiving locking pieces 33. Cover 32, shown in FIGS. 4 and 5, also has a corresponding receptacle, so that locking pieces 33 rest between base 31 and cover 32.

Figure 6:
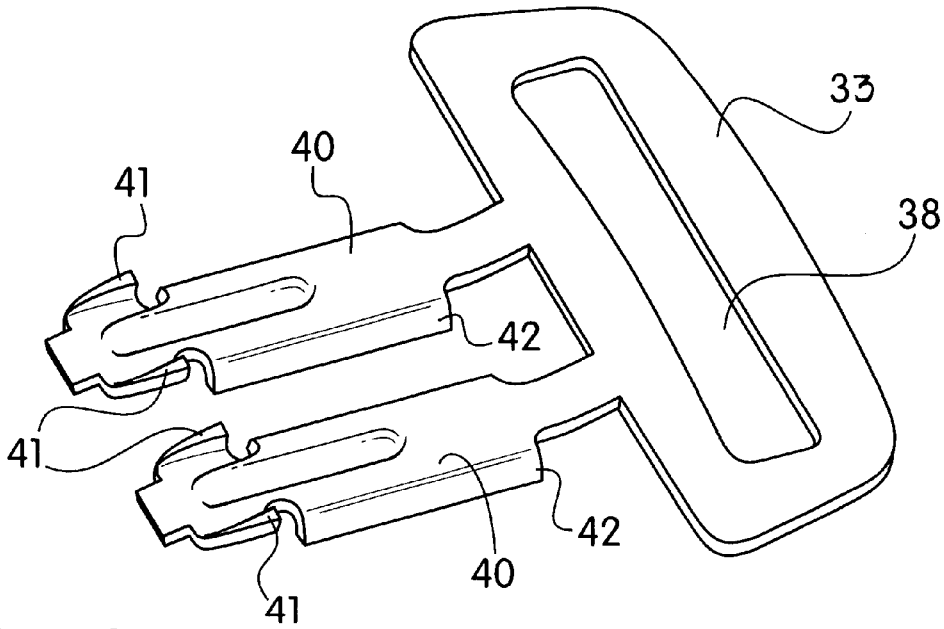
FIG. 6 shows a perspective view of one of the pieces of the metal locking body in the buckle according to the invention.
Figure 7:
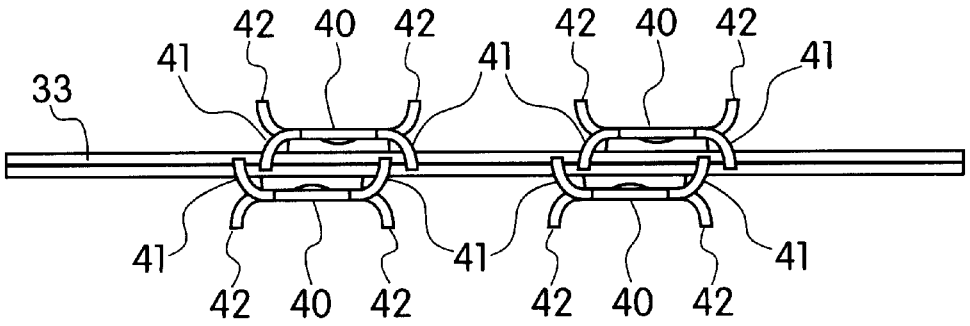
FIG. 7 shows a cross-sectional view of the two pieces of the metal locking body placed together.

As shown in FIG. 6, each female locking piece 33 has two legs 40, which rest in receptacle 36 of base 31. Each leg 40 has two curved edges 42 and two oppositely curved latches 41 on its free end. Legs 40 are disposed slightly off-center on locking piece 33, so that when two pieces 33 are placed together, latches 41 intermesh, as shown in FIG. 7. Each locking piece 33 has an aperture 38 for receiving a strap.

Figure 8:
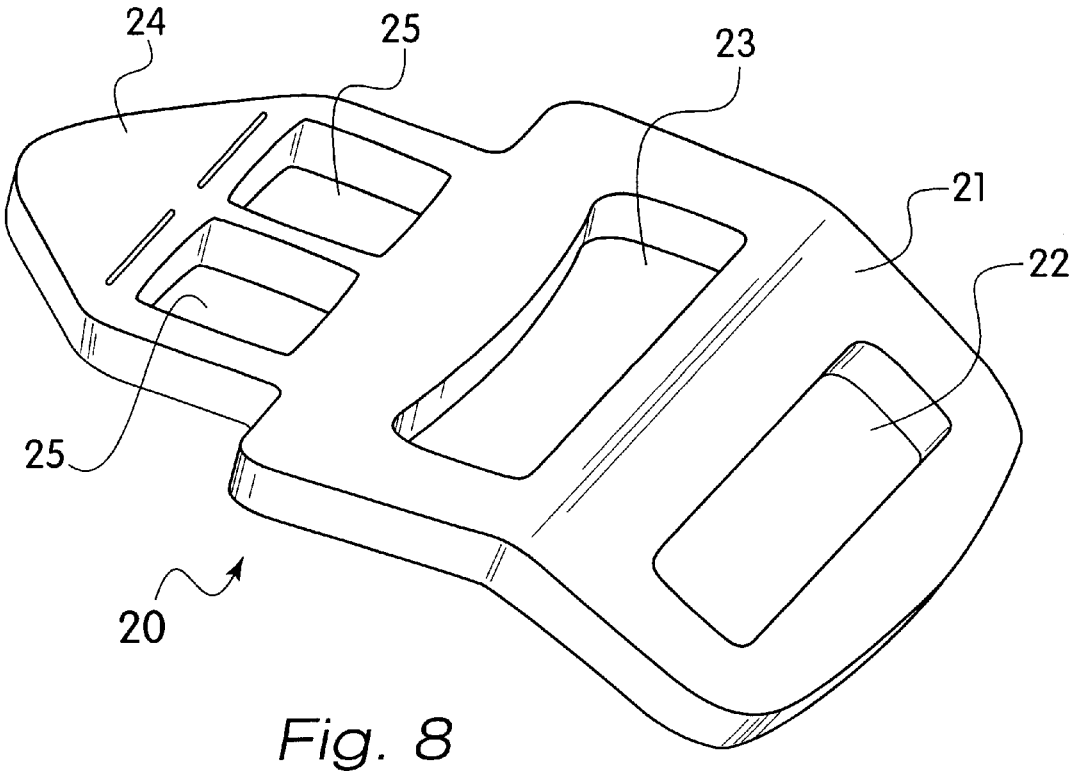
FIG. 8 shows the metal male portion of the buckle according to the invention.

Male portion 20 is shown in FIG. 8. Male portion 20 is comprised of a body 21 and an insertion plate 24. Body 21 has two apertures 22 and 23 for receiving a strap threaded therethrough. Insertion plate 24 has two apertures 25 for receiving latches 41 of locking pieces 33 on female portion 30, to lock buckle 10 closed.

Figure 9:
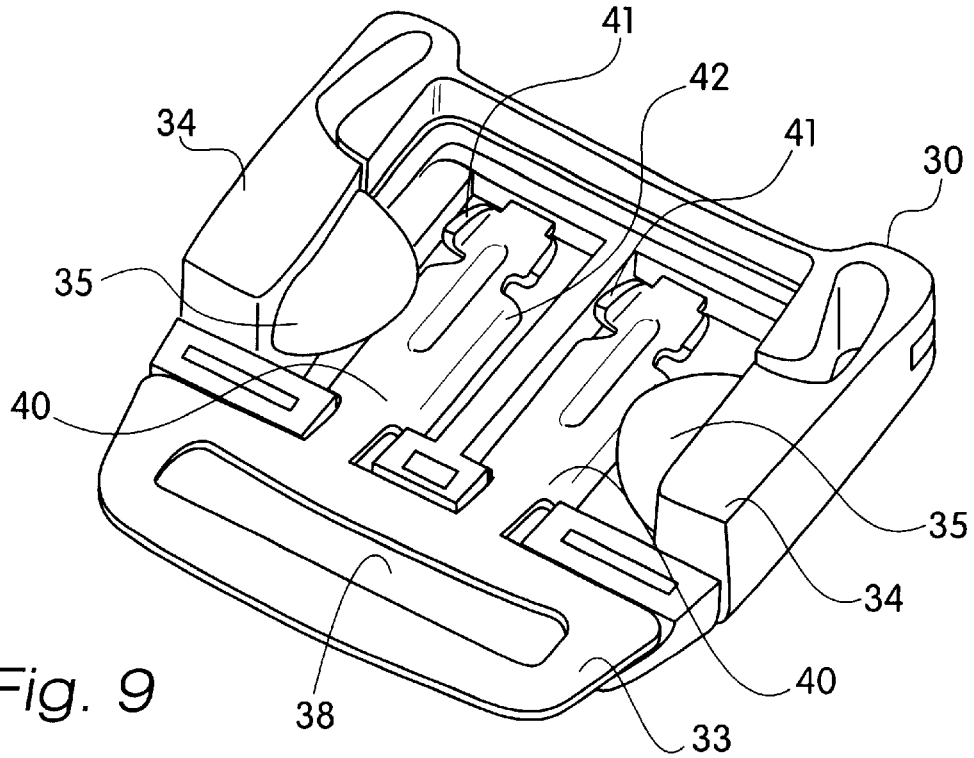
FIG. 9 shows a perspective view of one of the pieces of the metal locking body inserted in the base.
Figure 10:
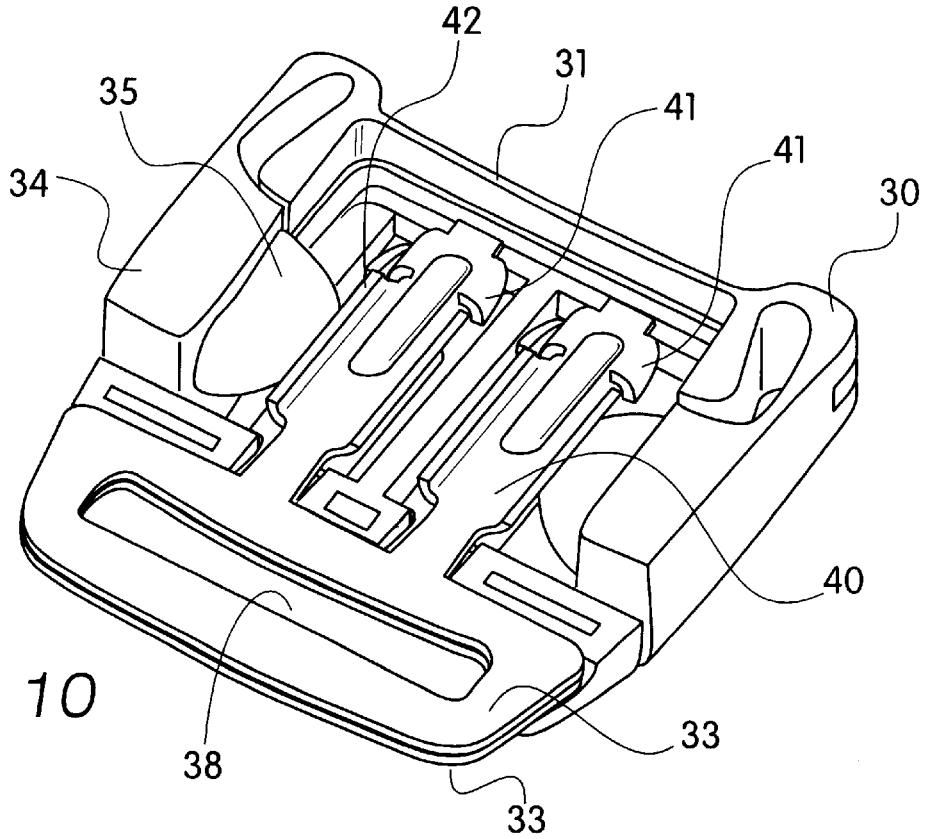
FIG. 10 shows a perspective view of both pieces of the metal locking body inserted in the base.

As shown in FIGS. 9 and 10, locking pieces 33 fit into receptacle 36 of base 31 and are kept in place by the design of receptacle 36. FIG. 9 shows the placement of one locking piece 33 and FIG. 10 shows the placement of both locking pieces 33. Fingers 35 on flexible arms 34 fit in between the two locking pieces 33.

Figure 11:
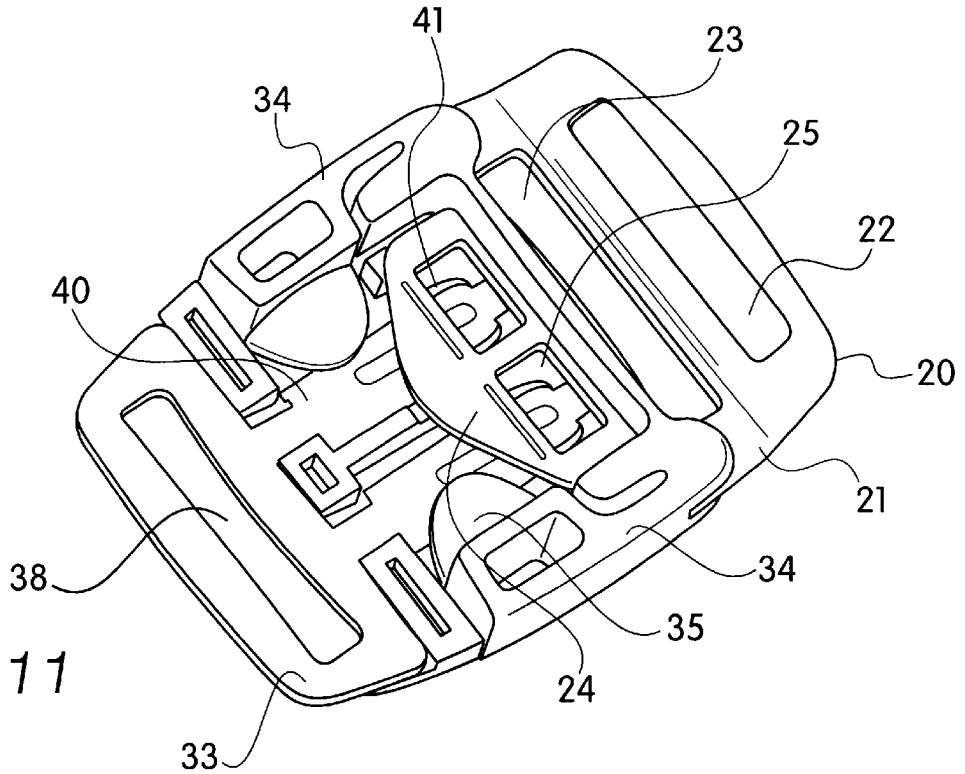
FIG. 11 shows a perspective view of the male portion inserted in the assembly shown in FIG. 9.
Figure 12:
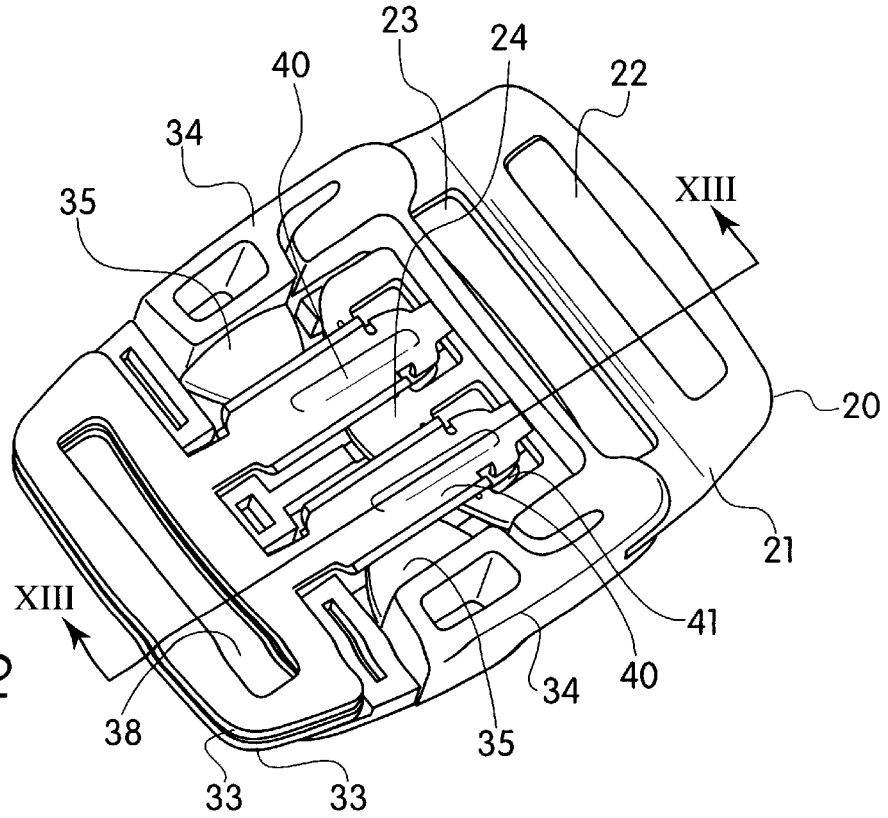
FIG. 12 shows a perspective view of the male portion inserted in the assembly shown in FIG. 10.

To assemble the buckle, male portion 20 is inserted in between the two locking pieces 33, as shown in FIGS. 11 and 12. FIG. 11 shows the buckle assembly with only one of the two locking pieces 33 in place, while FIG. 12 shows the entire assembly except for cover 32. Male portion 20 is kept locked in between locking pieces 33 by latches 41, which engage apertures 25 on male portion 20. A total of eight latches 41 engage apertures 25 to ensure a secure lock of buckle 10.

Figure 13:
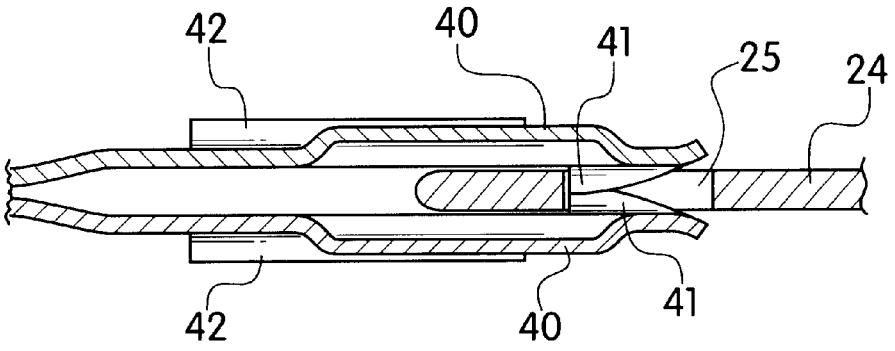
FIG. 13 shows a side cross-sectional view of the male portion locked between two locking legs of the female portion along lines XIII—XIII of FIG. 12.
Figure 14:
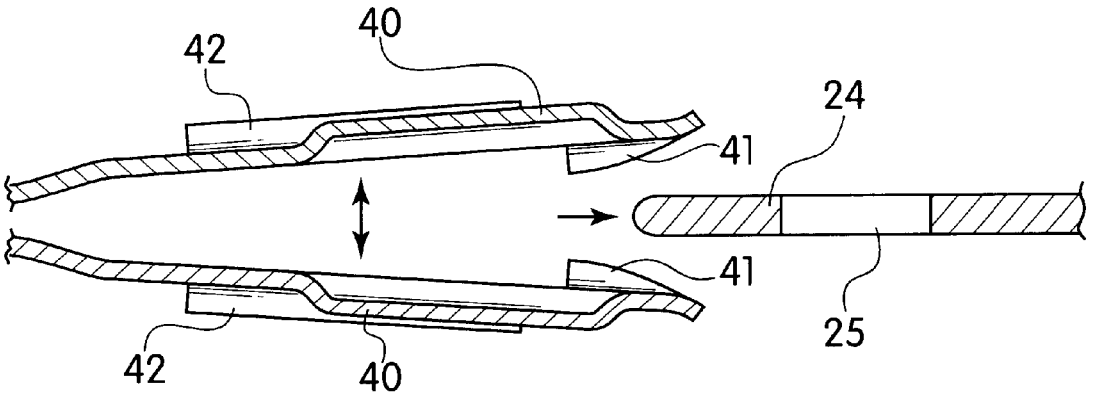
FIG. 14 shows a side cross-sectional view of the male portion being released from the two locking legs of the female portion.

FIG. 13 shows a cross-sectional view of the insertion plate 24 of male portion 20 inserted and locked between locking pieces 33 of female portion 30. Latches 41 are shown inserted into aperture 25 to keep male portion 20 locked. To release male portion 20, the user presses arms 34 of base 31 inward. This causes fingers 35 to press in between locking pieces 33 to pry them apart. When fingers 35 are pressed inward, locking pieces 33 bend at the junction where legs 40 begin, since this is the narrowest portion of legs 40. Once fingers 33 are pried apart, latches 41 are no longer inserted into apertures 25 and male portion 20 can then be slid out from between locking pieces 33, as shown in FIG. 14. Once fingers 35 are released, locking pieces 33 return to an unbent state. Male portion 20 is identical on both of its face sides, so it can be inserted and locked into female portion 30 in both orientations.

Accordingly, while only a single embodiment of the present invention has been shown and described, it is obvious that many changes and modifications may be made thereunto without departing from the spirit and scope of the invention.

What is claimed is:

1. A buckle comprising:

a metal male portion having means for attaching the male portion to a strap and an insertion plate having side edges and upper and lower planar surfaces; and a female portion comprising:

a metal locking body comprising means for attaching the female portion to a strap and at least two locking legs that releasably lock with the insertion plate of the male portion, each of said locking legs having a top planar surface, a bottom planar surface and side edges and said insertion plate inserting between the top surface of one locking leg and the bottom surface of the other locking leg and said locking legs locking the plate on said upper and lower surfaces of the plate to prevent unauthorized release of the insertion plate from the locking legs under high torque; and a plastic housing surrounding at least a portion of the metal locking body, said plastic housing having a top surface, a bottom surface and two lateral sides and having means for separating said locking legs and releasing the metal locking body from the male portion.

2. The buckle according to claim 1, wherein the metal locking body has four locking legs, two locking legs locking on one side of the male portion and the other two locking legs locking on an opposite side of the male portion.

3. The buckle according to claim 2, wherein the insertion plate has at least one aperture therethrough and wherein each locking leg has at least one latch, such that each latch engages said at least one aperture to lock the male portion to the female portion when the male portion is inserted between the two locking legs.

4. The buckle according to claim 3, wherein the metal locking body comprises two identical flat pieces, each piece containing two locking legs, such that placing said pieces together forms four locking legs.

5. The buckle according to claim 4, wherein said locking legs have longitudinal ridges extending along two edges of each leg or an opposite surface from said latches, and wherein said locking legs are offset from the center of the piece, so that placing said two pieces together causes said latches on one piece to nest with the latches on said other piece.

6. The buckle according to claim 1, wherein the means for separating the locking legs comprises at least one arm integrally formed with the plastic housing along one of said two lateral sides, said at least one arm having a free end with a finger extending toward said metal locking body, such that pressing said arm inward forces the finger between said at least two locking legs and forces said locking legs apart to release the male portion from the female portion.

7. The buckle according to claim 1, wherein the plastic housing comprises a base and a cover, so that said metal locking body is mounted in said base and said cover is placed over said metal locking body to assemble said female portion.

8. The buckle according to claim 1, wherein the means for attaching the female and male portions to a strap comprises at least one bar mounted across an end of each of the male portion and the metal locking body of the female portion.

* * * * *